US007249760B2

(12) United States Patent
Liu et al.

(10) Patent No.: US 7,249,760 B2
(45) Date of Patent: Jul. 31, 2007

(54) PAPER PICKUP MECHANISM

(75) Inventors: Yuan-Chin Liu, Fengshan (TW); Chiung-Yi Su, Hsinchuang (TW); Hsueh-Chou Hsu, Kaohsiung (TW)

(73) Assignee: Lite-On Technology Corporation, Taipei (TW)

( * ) Notice: Subject to any disclaimer, the term of this patent is extended or adjusted under 35 U.S.C. 154(b) by 469 days.

(21) Appl. No.: 10/796,078

(22) Filed: Mar. 10, 2004

(65) Prior Publication Data

US 2004/0262833 A1 Dec. 30, 2004

(30) Foreign Application Priority Data

Jun. 27, 2003 (TW) ..... 92211760 U

(51) Int. Cl.
*B65H 3/06* (2006.01)

(52) U.S. Cl. ..... 271/114; 271/117; 74/396

(58) Field of Classification Search ..... 271/113, 271/117, 118, 109, 114; 74/395, 396, 397, 74/411.5

See application file for complete search history.

(56) References Cited

U.S. PATENT DOCUMENTS

| | | | | |
|---|---|---|---|---|
| 5,527,026 | A | 6/1996 | Padget et al. | |
| 5,547,181 | A * | 8/1996 | Underwood | 271/114 |
| 6,547,236 | B1 * | 4/2003 | Yip et al. | 271/115 |
| 6,690,909 | B2 * | 2/2004 | Su | 399/364 |
| 6,877,735 | B2 * | 4/2005 | Fujiwara | 271/117 |
| 6,988,722 | B2 * | 1/2006 | Su | 271/117 |

* cited by examiner

*Primary Examiner*—Patrick Mackey
*Assistant Examiner*—Thomas Morrison
(74) *Attorney, Agent, or Firm*—Rabin & Berdo, P.C.

(57) ABSTRACT

A paper pickup mechanism mounted in a feeder includes several driving gears, connecting rods, a pickup roller and a twist restricting gear. By means of the twist restricting gear, the paper pickup mechanism provides an equal pickup force under different paper loads. Furthermore, the operational precision of the pickup roller is improved via relative motion with the twist restricting gear.

8 Claims, 4 Drawing Sheets

PAPER PICKUP MECHANISM

BACKGROUND OF THE INVENTION

1. Field of Invention

The present invention relates to a paper pickup mechanism, and more particularly, to a paper pickup mechanism that provides an equal pickup force under different paper loads, and operates with high precision.

2. Related Art

Usually, a paper pickup mechanism of various types such as a copy machine, a fax machine and a printer has two rubber rollers respectively with high coefficients of friction. One of the rubber rollers is a pickup roller and the other is a feed roller. A topmost paper of the paper load stack is picked by the pickup roller and conveyed to a printing module by a feed roller.

In a traditional paper pickup mechanism that uses a pickup roller to pick up paper, driving energy is usually dissipated through the gear mechanism, and noise is produced due to the friction between two contacting rollers when the papers are transmitted. Therefore, a reduced number of rollers are preferable to reduce inter-roller friction. Furthermore, multi-feeds or feed failure may occur due to weight, density or stiffness of papers.

The rollers may be movable for automatic compensation of the pickup roller. One common approach is to mount the pickup roller at one swing arm or at one end of a set of gears, as disclosed in U.S. Pat. No. 5,527,026. This can automatically compensate the pickup force for different types of papers. However, for one type of paper, the swing range of the pickup roller, being mounted at one swing arm and operating under a different paper load, must be large. This mount provides non-uniform pickup forces, which results in unsatisfactory operational precision.

SUMMARY OF INVENTION

Therefore, the invention provides a paper pickup mechanism that solves the problems of the prior art such as non-uniform pickup forces under different paper loads and low operational precision.

In order to achieve the above and other objectives, the paper pickup mechanism of the invention includes a plurality of driving gears, a plurality of connecting rods, a pickup roller and a twist restricting gear. The pickup roller is driven in rotation and sliding move to cause a topmost paper to move. The twist restricting gear engages with one of the driving gears and rotates only when being subjected to a twist force greater than a predetermined twist force. The twist restricting gear thereby restricts the pickup operation of the pickup roller to provide a constant pickup force under different paper loads.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below illustration only, and thus are not limitative of the present invention, and wherein.

DETAILED DESCRIPTION OF THE INVENTION

Figure 1:
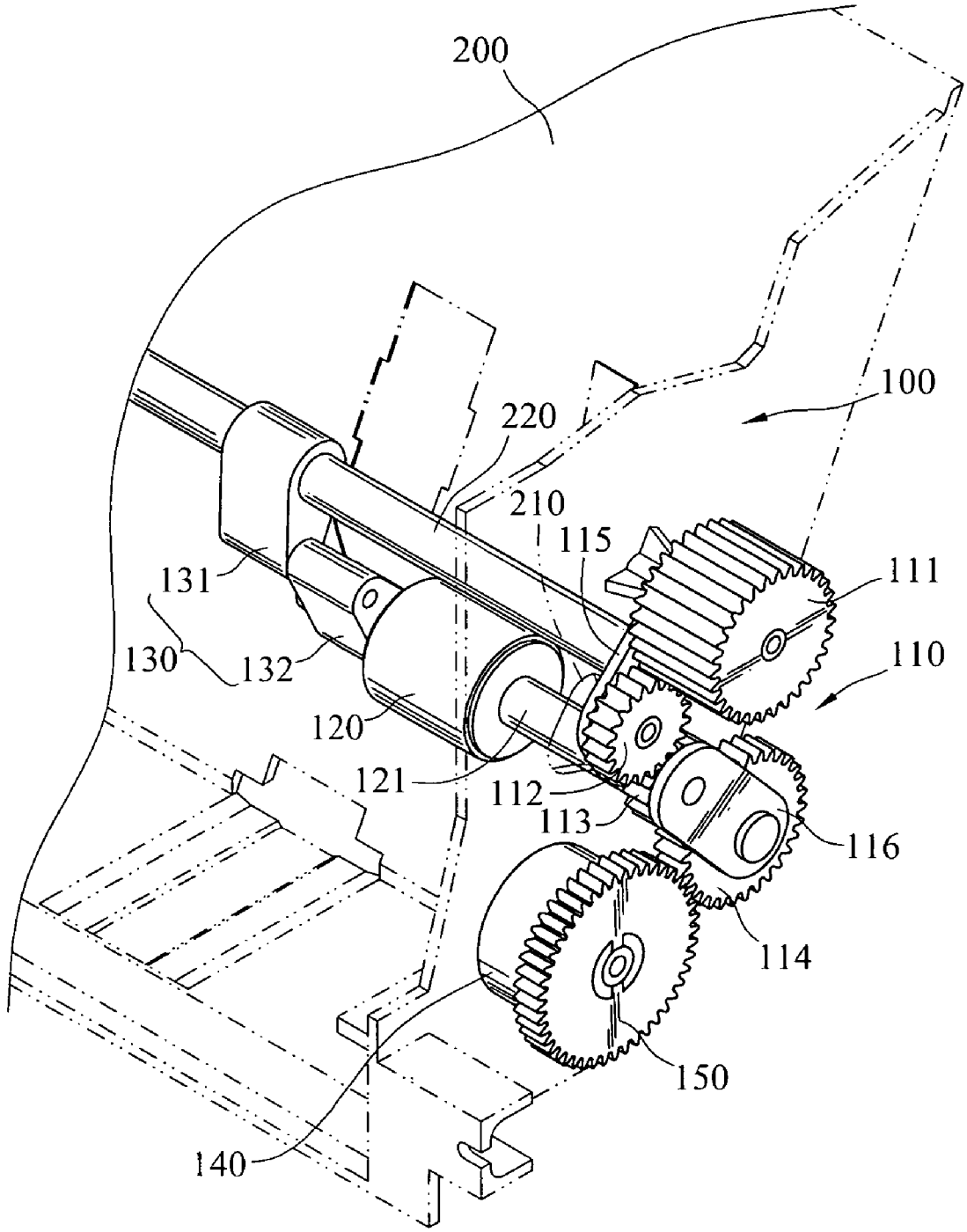
FIG. 1 is a perspective view of a paper pickup mechanism according to one embodiment of the invention, the broken line indicating the boundary of a feed tray.

Referring to FIG. 1 to FIG. 6, a paper pickup mechanism 100 according to one preferred embodiment of the invention is mounted on a vertical type feed tray 200. The paper pickup mechanism 100 includes a gear set 110, a pickup roller 120, a set of swing arms 130, a twist limiter 140 and a twist restricting gear 150. The arrangement and operation of the above components are described below.

Figure 2:
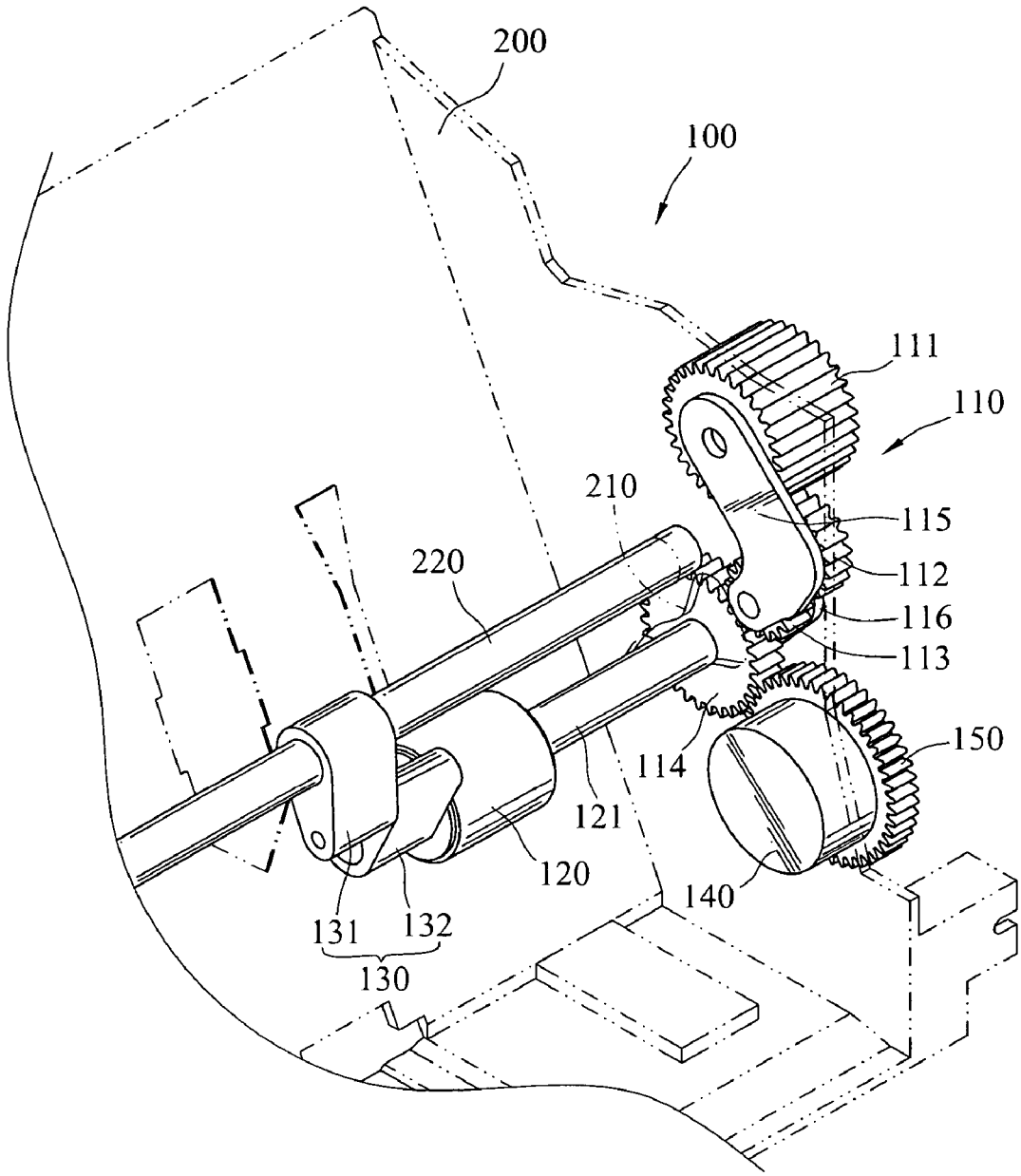
FIG. 2 is a perspective view of a paper pickup mechanism taken from a different angle of view according to one embodiment of the invention, the broken line indicating the boundary of the feed tray.

Referring to FIG. 1 and FIG. 2, the gear set 110 includes a driving gear 111, a first driven gear 112, a second driven gear 113, a transmission gear 114, a first connecting rod 115 and a second connecting rod 116. The driving gear 111 inputs a driving power. The first and second driven gears 112, 113 engage with each other. The driving gear 111 engages with the first driven gear 112. The second driven gear 113 further engages with the transmission gear 114. The driving gear 111, the first driven gear 112 and the second driven gear 113 interconnect with the first connecting rod 115 of a substantial L shape. The second driven gear 113 and the transmission gear 114 interconnect with the second connection rod 116. In the above configuration, the transmission gear is movably located at the lowest position. When the driving gear 111 rotates to drive the related gears in rotation, friction between the gears and the connecting rods drives the transmission gear 114 to rotate and move in a sliding motion. Furthermore, the transmission gear 114 pivotally connects with a pickup shaft 121 that extends through a sidewall slot 210 into a feed tray 200.

The pickup roller 120 has a high-friction picking surface to contact with the paper to be fed. The pickup roller 120 is mounted inside the feed tray 200 to pivotally connect to the pickup shaft 121. The sidewall slot 210, through which the pickup shaft 121 penetrates, has a profile shaped in an inclined arcuate curve. The sidewall slot 210 has an inner radius larger at its top edge than at other portions, to position the transmission gear 114 at a higher level when the transmission gear 114 is not in operation. In other words, the pickup roller 120 is also located at a higher level so that the inner space of the feed tray is larger for greater paper load.

The set of swing arms 130 includes a first arm 131 and a second arm 132 which connect to each other. A top of the first arm 131 connects to a suspended arm 220 that stretches across the feed tray 200. A bottom of the second arm 132 connects to the pickup roller 120.

The twist limiter 140 is mounted on outer side the feed tray 200, below the transmission gear 114 relatively. The twist restricting gear 150 is disposed on one side of the twist limiter 140 and pivotally connects to the transmission gear 114 in a manner that when the transmission gear 114 rotates, the transmission gear 114 engages with the twist restricting gear 150. The twist limiter 140 provides a predetermined twist force to the twist restricting gear 150. The twist restricting gear 150 rotates only when a twist force proved by the gear set 110 is greater than the predetermined twist force is applied thereon. The predetermined twist force is determined based on the twist force required for conveying the paper when the pickup roller 120 contacts with the paper. Practically, the twist limiter 140 is a twist spring or other damping device. If a damping fluid is applied over the shaft of the twist restricting gear 150 to provide enough resistance, the twist limiter 140 can be omitted.

Figure 3:
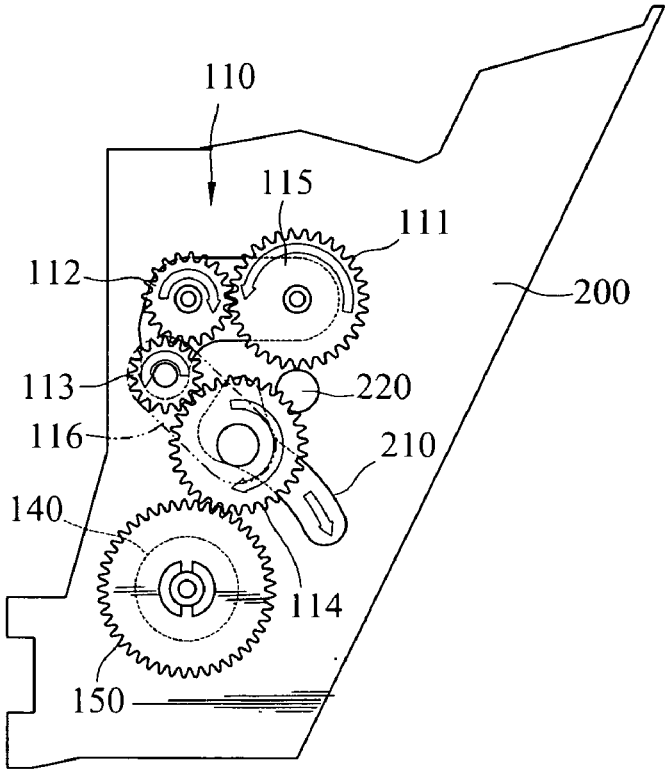
FIG. 3 is a schematic view illustrating the operation of a paper pickup mechanism outside a feed tray when paper is not picked up, according to one embodiment of the invention.
Figure 4:
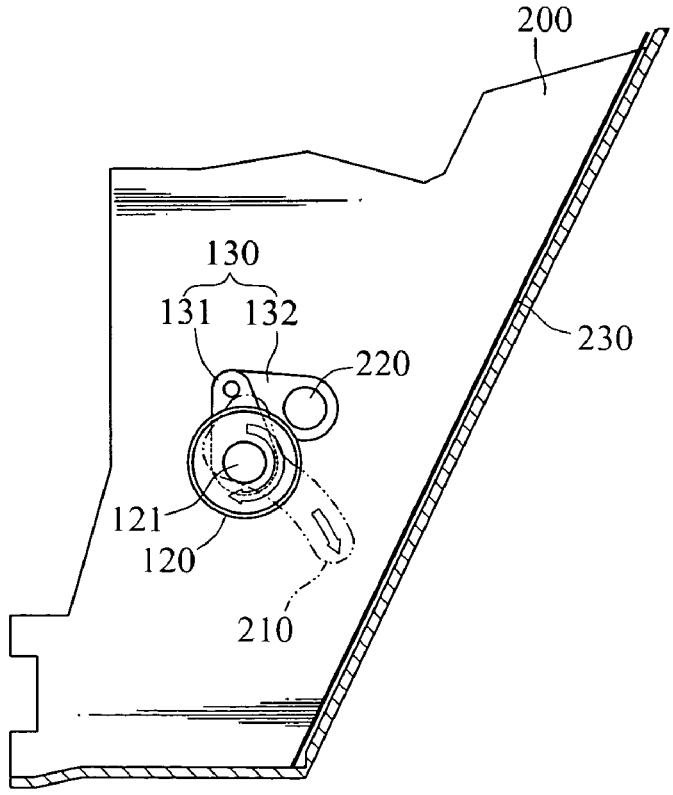
FIG. 4 is a schematic view illustrating the operation of a paper pickup mechanism inside a feed tray when paper is not picked up, according to one embodiment of the invention.

Referring to FIG. 3 and FIG. 4 in conjunction with FIG. 1 and FIG. 2, in the paper pickup operation, the driving gear 111 provides a counterclockwise rotational force to sequentially drive the first and second driven gears 112, 113 and the transmission gear 114 in rotation, the transmission gear 114 descends from the top edge of the sidewall slot 210 until it contacts with the twist restricting gear 150. The pickup roller 120 rotates and moves as the transmission gear 114 acts. The pickup roller 120 and the transmission gear 114 are movable. Therefore, the twist force supplied by the power source does not need to be as high as that supplied by the twist limiter 140. In other words, the twist restricting gear 150 does not rotate at this moment, and the transmission gear 114 moves toward a paper 230 and, meanwhile, rotates and engages with the twist restricting gear 150.

Figure 5:
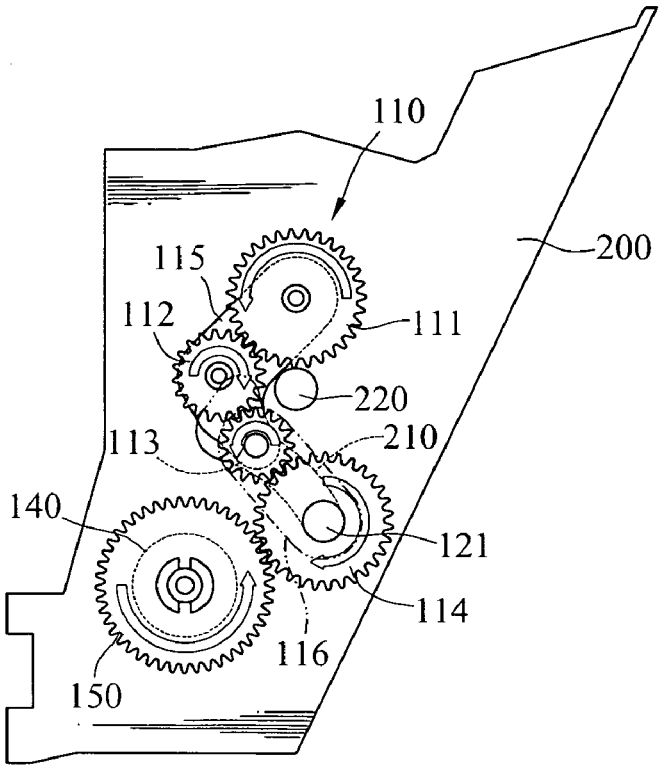
FIG. 5 is a schematic view illustrating the operation of a paper pickup mechanism outside a feed tray when paper is picked up, according to one embodiment of the invention.
Figure 6:
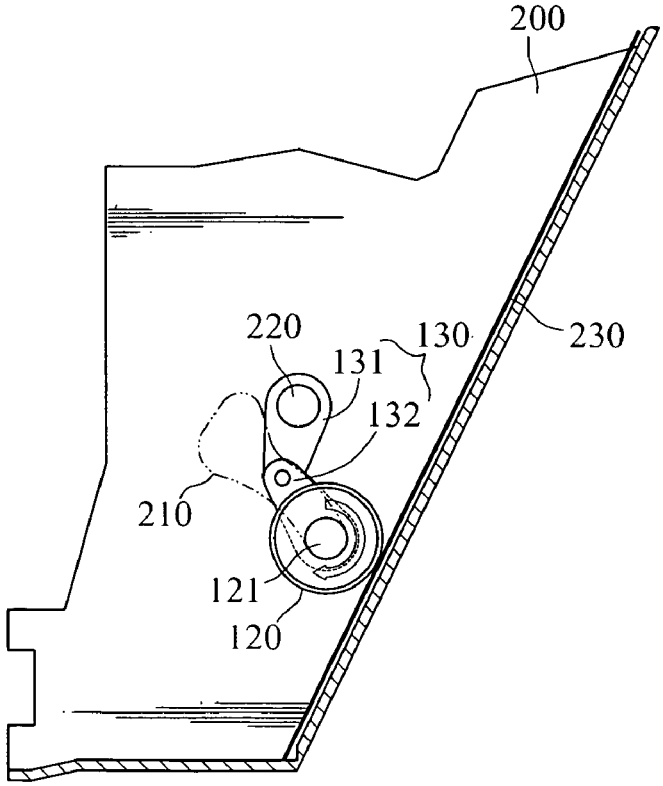
FIG. 6 is a schematic view illustrating the operation of a paper pickup mechanism inside a feed tray when paper is picked up, according to one embodiment of the invention.

Referring to FIG. 5 and FIG. 6, after the pickup roller 120 comes in contact with the paper 230, the friction between the pickup roller 120 and the paper 230 increases the twist force required to keep the transmission gear 114 rotating. When the twist force transmitted from the gear set 110 is greater than the predetermined twist force of the twister limiter 140, the twist restricting gear 150 and the transmission gear 114 are driven in rotation simultaneously to drive the pickup roller 120 to convey the paper 230. When the paper 230 moves to the feeding roller (not shown), the power source supplies a reverse twist force to allow the above components to turn back to their original positions.

As described above, the transmission gear is supplied with a predetermined twist force to limit the pickup force to a constant value regardless of the paper load, which may include 200 or 5 paper sheets. Furthermore, with the twist restricting gear, the moving path of the pickup roller is well controlled to increase operational precision.

To achieve an automatic compensation under different paper loads, a twist force adjustment means may be further provided to adjust the predetermined twist force.

It is noted that the mechanism used to drive the transmission gear and pickup roller is not limited to those described above. For example, the number and arrangement of swing arms are not particularly limited to the above embodiments. A person skilled in the art can readily understand that the swing arms are equivalent to the connecting rods. The gear set may include, in addition to the transmission gears, various assemblies of gears and connecting rods. Furthermore, the number of sets of driving gears is not particularly limited to the description herein.

Furthermore, the transmission gear, the twist limiter and the twist restricting gear may be located at positions other that the outside of the feed tray. One variation of the paper pickup mechanism of the invention can be also applied to a transversal type feed tray.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A paper pickup mechanism mounted in a feed tray, comprising:

a pickup shaft;

a gear set, including:

a transmission gear provided at one end of the gear set, a center of the transmission gear being pivotally connected to the pickup shaft;

a driving gear, transmitting power from a power source;

a first driven gear that is engaged with the driving gear;

a second driven gear that is engaged with the first driven gear and engaged with the transmission gear;

a first connecting rod that connects the driving gear to the first driven gear and to the second driven gear; and a second connecting rod that connects the transmission gear to the second driven gear;

a pickup roller, mounted in the feed tray and being pivotally connected to the pickup shaft;

a set of interconnected swing arms, one of the swing arms being connected to the pickup roller, and another of the swing arms being connected to a suspended arm in the feed tray;

a twist restricting gear, disposed on a side of the feed tray, and engaging with the transmission gear; and means for allowing the twist restricting gear to rotate only when a twist force provided by the gear set applied to the twist restricting gear is greater than a predetermined force;

wherein the transmission gear is mounted outside the feed tray, and the feed tray has a sidewall slot through which the pickup shaft penetrates.

2. The paper pickup mechanism of claim 1, wherein the means for allowing comprises a twist limiter mounted adjacent the transmission gear for providing the predetermined force.

3. The paper pickup mechanism of claim 2, wherein the twist limiter is a twist spring.

4. The paper pickup mechanism of claim 1, wherein the sidewall slot has a profile of an inclined arcuate curve whose inner radius at its top edge is greater than at other portions of the inclined arcuate curve.

5. The paper pickup mechanism of claim 2, wherein the twist limiter and the twist restricting gear are mounted on an outer side of the feed tray.

6. The paper pickup mechanism of claim 1, wherein the first connecting rod has an approximately L shape.

7. The paper pickup mechanism of claim 1, wherein the set of swing arms includes a first arm and a second arm which are interconnected to each other, one end of the first arm being connected to the suspended arm, and one end of the second arm being connected to the pickup roller.

8. The paper pickup mechanism of claim 1, wherein the feed tray is a vertical feed tray.

* * * * *